US012139801B2

(12) United States Patent
Wakerley et al.

(10) Patent No.: US 12,139,801 B2
(45) Date of Patent: Nov. 12, 2024

(54) ELECTRONEUTRAL POROUS SEPARATOR FOR OXOCARBON ELECTROLYZER

(71) Applicant: Dioxycle, Bordeaux (FR)

(72) Inventors: David Wakerley, Paris (FR); Edward Luke Malins, Bordeaux (FR); Sarah Lamaison, Paris (FR); Renjie Liu, Paris (FR)

(73) Assignee: Dioxycle, Bordeaux (FR)

( * ) Notice: Subject to any disclaimer, the term of this patent is extended or adjusted under 35 U.S.C. 154(b) by 0 days.

(21) Appl. No.: 18/123,353

(22) Filed: Mar. 20, 2023

(65) Prior Publication Data

US 2023/0304177 A1 Sep. 28, 2023

Related U.S. Application Data

(60) Provisional application No. 63/446,321, filed on Feb. 16, 2023, provisional application No. 63/322,639, filed on Mar. 22, 2022.

(51) Int. Cl.

| | |
|---|---|
| ***C25B 13/08*** | (2006.01) |
| ***C25B 3/03*** | (2021.01) |
| ***C25B 3/26*** | (2021.01) |
| ***C25B 9/19*** | (2021.01) |

(52) U.S. Cl.

CPC ..... *C25B 13/08* (2013.01); *C25B 3/03* (2021.01); *C25B 3/26* (2021.01); *C25B 9/19* (2021.01)

(58) Field of Classification Search

None

See application file for complete search history.

(56) References Cited

U.S. PATENT DOCUMENTS

| | | | |
|---|---|---|---|
| 6,287,730 | B1 | 9/2001 | Callahan et al. |
| 8,173,305 | B2 | 5/2012 | Holzapfel et al. |
| 9,518,329 | B2 | 12/2016 | Wang et al. |
| 10,490,849 | B2 | 11/2019 | Lee et al. |
| 10,883,180 | B2 | 1/2021 | Ono et al. |
| 10,961,632 | B2 | 3/2021 | Ono et al. |
| 11,130,723 | B2 | 9/2021 | Kudo et al. |

(Continued)

FOREIGN PATENT DOCUMENTS

EP 3626858 A1 3/2020

OTHER PUBLICATIONS

Fang et al. (Journal of Membrane Science 549 (2018) 332-349) (Year: 2018).*

(Continued)

*Primary Examiner* — Wojciech Haske

(74) *Attorney, Agent, or Firm* — Daylight Law, P.C.

(57) ABSTRACT

Methods and systems related to oxocarbon electrolyzers are disclosed herein. A disclosed system includes an oxocarbon electrolysis reactor with an anode area with an oxidation substrate, cathode area with an oxocarbon species as a reduction substrate, and an electroneutral separator separating the anode area and the cathode area while allowing ionic migration between the anode area and cathode area. The electroneutral separator may be a porous electroneutral separator. The oxocarbon electrolyzer may also include a conductive electrolyte applied to the separator. Ionic migration between the anode area and the cathode area may be accomplished via the conductive electrolyte in the porous electroneutral separator.

16 Claims, 7 Drawing Sheets

(56) References Cited

U.S. PATENT DOCUMENTS

| | | | | |
|---|---|---|---|---|
| 2008/0257722 | A1* | 10/2008 | Tomba | C25B 13/08 204/295 |
| 2019/0085470 | A1* | 3/2019 | Ono | H01M 50/489 |
| 2020/0002822 | A1* | 1/2020 | Ono | C25B 9/00 |
| 2021/0079543 | A1* | 3/2021 | Mikoshiba | C25B 9/77 |
| 2021/0292926 | A1 | 9/2021 | Ono et al. | |
| 2022/0298655 | A1* | 9/2022 | Kofuji | C25B 13/08 |

OTHER PUBLICATIONS

Davis J, Membranelss Electrolyzers for Solar Fuel Production, Columbia University, Doctoral Theses, 2019. (Available at: https://academiccommons.columbia.edu/doi/10.7916/d8-ypyq-6d71).

Lin R, Guo J, Li X, Patel P, Seifitokaldani A. Electrochemical Reactors for CO2 Conversion. Catalysts. 2020; 10(5):473. (Available at: https://doi.org/10.3390/catal10050473).

International Search Report and Written Opinion from International Application No. PCT/IB2023/052735 dated Sep. 12, 2023, 9 pages.

Non-Final Office Action dated Apr. 24, 2024 from U.S. Appl. No. 18/582,903, 11 pages.

* cited by examiner

ELECTRONEUTRAL POROUS SEPARATOR FOR OXOCARBON ELECTROLYZER

CROSS REFERENCE TO RELATED APPLICATIONS

This application claims the benefit of U.S. Provisional Patent Application No. 63/446,321 filed Feb. 16, 2023, and U.S. Provisional Patent Application No. 63/322,639 filed Mar. 22, 2022, which are both incorporated by reference herein in their entireties for all purposes.

BACKGROUND

There is an urgent need to reduce the emissions related to the production of useful fuels and chemicals in our society. Furthermore, there is an urgent need to develop technologies which make the capture or direct valorization of carbon dioxide more economical. Accordingly, technologies that both generate useful fuels and chemicals, while at the same time using carbon dioxide feedstock that would otherwise have been emitted into the atmosphere, are critically important because they both generate useful chemicals without additional emissions and because the economic value of the useful chemicals can offset the cost of carbon dioxide capture and conversion.

A class of technologies that can address the problems outlined in the prior paragraph are oxocarbon electrolyzers. These devices take an oxocarbon as an input and can be used to produce valuable chemicals by valorizing the oxocarbon. Electrolyzers are reactors that operate using a paired reduction and oxidation reaction. The reduction reaction occurs in a cathode area of the reactor and the oxidation reaction occurs in an anode area of the reactor. The two areas are separated by a charged ion exchange membrane. The charged ion exchange membrane allows ions from the reduction and/or oxidation reaction to migrate across the reactor to allow for the reduction and oxidation reactions to take place. The charged ion exchange membranes can be configured to allow facile migration of anions, cations, or both types of charged ions. In addition to providing for ion migration, the ion exchange membranes must be mechanically stable as they serve to physically isolate compartments of the electrolyzer and can also serve as supports for electrodes in either the anode area, the cathode area, or both.

The ion exchange membrane can take the form of one or more charged membranes chosen among anion-exchange membranes (such as, but not limited to, commercial Aemion®, Orion®, Sustainion®, Piperion®, ionomer anion-exchange membranes), cation-exchange membranes (such as but not limited to Nation®, Aquivion® or commercial membranes), and bipolar membranes (such as, but not limited to, Fumasep® FBM and Xion®). An anion-exchange membrane may be prepared using N-bearing monomers. Anion exchange membranes in oxocarbon electrolyzers are designed to selectively allow anions, such as hydroxide, to migrate from the cathode area to the anode area. Cation exchange membranes in oxocarbon electrolyzers are designed to selectively allow cations to migrate from the anode area to the cathode area. Bipolar membranes include both an anion exchange membrane and a cation exchange membrane with a water dissociation layer between the two membranes, and allow both anions and cations to migrate between the anode area and the cathode area of the electrolyzer.

Charged ion exchange membranes are charged through the implanting of charged chemicals into the material that forms the membrane to facilitate their ability to allow for the migration of ions. Approaches for treating separator material by implanting charged chemicals while maintaining sufficient mechanical stability and other desirable characteristics for separators in electrolysis reactors are expensive which adds significantly to the overall cost of the electrolysis reactor into which they are installed.

SUMMARY

This disclosure relates to separators used in oxocarbon electrolyzers. In specific embodiments of the invention, an electrolysis reactor includes an anode area and a cathode area with an electroneutral separator separating the anode area and the cathode area. The electroneutral separator can be a membrane, diaphragm, or any separator. The electroneutral separator can be formed by electrically insulative material while being ionically conductive. As such, the separator can allow for ionic migration between the anode area and cathode area while still separating the anode area and the cathode area. The separator can also serve as a support for one or more electrodes in the anode area or cathode area. The separator can be electroneutral in that it is formed entirely of insulative material. The separator can be electroneutral in that no charged chemicals are bound into the electroneutral separator. The incorporation of charged chemicals into a membrane is a costly process that significantly increases the cost of the membrane. As such, using approaches disclosed herein, an electrolysis reactor can thereby provide for migration of ionic species between the anode and cathode while the overall cost of the electrolyzer is greatly reduced. Furthermore, as the amount of incorporated electrical charge and mechanical stability of a traditional membrane are often tradeoffs in the design, approaches disclosed herein exhibit significant benefits in that the separator can be made mechanically sturdy without regard to optimizing for a negatively correlated property.

The use of an electroneutral separator provides significant benefits as compared to other approaches because the cost of fabrication is lower and because the separator is overall more reliable that alternative approaches. The ion conducting membrane in an oxocarbon electrolyzer is one of its major sources of unreliability. The necessity to present both an ion exchange environment and structural stability to the electrode presents a zero-sum game, where increases to the structural stability of the membrane comes at the cost of ion exchange capacity and visa-versa. This makes the production of stable oxocarbon electrolyzer stacks particularly difficult and important. The separator is a critical component and membrane ruptures in one cell may lead to deactivation of the entire unit. The use of charged membranes also prevents the use of high differential pressures across the electrolyzer, due to structural weakness, but these high differential pressures are often desirable in order to encourage the correct catalytic environment in the system. High differential pressures are also an unavoidable result of the source of the oxocarbon having a variable pressure (e.g., an industrial waste source) and therefore must be tolerated when processing the oxocarbons.

In specific embodiments of the invention, an electrolysis reactor includes an anode area and a cathode area with a porous separator separating the anode area and the cathode area. The porous separator can have pores with cross sections on the order of less than one millimeter down to hundreds of nanometers. The porous separator can include a porous network formed by a set of such pores that extend through the separator from one side of the separator to another side of the separator. The porous network extends through the separator in that there are paths from the one side of the separator to the other side of the separator through the porous network. In specific embodiments of the invention, this porous network can be filled with a liquid electrolyte after the separator is installed in the electrolyzer. Using the approaches disclosed herein, an electrolysis reactor can thereby provide for facile migration of ionic species between the anode and cathode to improve the performance of the electrolyzer. In specific embodiments of the invention, an electrolysis reactor can utilize an electroneutral porous separator. The electroneutral separator can be formed by electrically insulative material while being ionically conductive via the migration of ions through the porous network. A conductive electrolyte of the electrolysis reactor can fill the pores of the separator to provide a path for ions to migrate through the separator.

In specific embodiments of the invention, an electrolysis reactor includes an anode area and a cathode area separated by a porous separator where one of the two areas is an aqueous area and the other of the two areas is a gaseous area. The anode area could be an aqueous anode area and the cathode area could be a gaseous cathode area or vice versa. In these embodiments, a pump or other means can be used to produce a pressure difference across the electrolysis reactor from the anode area to the cathode area. A conductive electrolyte, or any other fluid, located in the aqueous area can be pressed away from the gaseous area by the pressure difference such that the fluid is kept in the porous separator, but does not extend into the gaseous area. Adjusting the pressure difference can adjust a degree of interactivity with the conductive electrolyte and a catalyst layer of the anode area or cathode area.

In specific embodiments of the inventions disclosed herein, an oxocarbon electrolysis reactor is provided. The oxocarbon electrolysis reactor comprises an anode area with an oxidation substrate, a cathode area with an oxocarbon species as a reduction substrate, and an electroneutral separator separating the anode area and the cathode area while allowing ionic migration between the anode area and cathode area.

In specific embodiments of the inventions disclosed herein, an oxocarbon electrolysis reactor is provided. The oxocarbon electrolysis reactor comprises an anode area with an oxidation substrate, a cathode area with an oxocarbon species as a reduction substrate, a porous separator separating the anode area and the cathode area, and a porous network formed by a set of pores and extending through the porous separator.

In specific embodiments of the inventions disclosed herein, a method of operating an oxocarbon electrolysis reactor is provided. The method comprises reducing an oxocarbon species in a cathode area, oxidizing an oxidation substrate in an anode area, separating the cathode area from the anode area using an electroneutral separator, and allowing ionic migration between the anode area and cathode area across the electroneutral separator.

BRIEF DESCRIPTION OF THE DRAWINGS

The accompanying drawings illustrate various embodiments of systems, methods, and embodiments of various other aspects of the disclosure. A person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Reference will now be made in detail to implementations and embodiments of various aspects and variations of systems and methods described herein. Although several exemplary variations of the systems and methods are described herein, other variations of the systems and methods may include aspects of the systems and methods described herein combined in any suitable manner having combinations of all or some of the aspects described.

Methods and systems related to novel separators and oxocarbon electrolysis reactors utilizing such novel separators in accordance with the summary above are disclosed in detail herein. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

The electrolyzers used in accordance with the approaches disclosed herein can have various architectures. The electrolyzer can include an anode area and a cathode area. An oxocarbon can be provided to the anode area of the reactor as a reduction substrate. Useful chemicals can be produced in the cathode area, in the anode area, or in a separating area located between the cathode area and the anode area of the electrolyzer. The rate at which the reaction occurs can be dependent upon the degree of ionic migration across one or more separators between the cathode area and the anode area. The electrolyzer can be a single planar electrolyzer. The electrolyzer can be a stack of cells. The cells in the stack can utilize bipolar plates. The bipolar plates can be charged to initiate reactions within the reactor. The electrolyzer can also be a filter press electrolyzer or a tubular electrolyzer.

Figure 1:
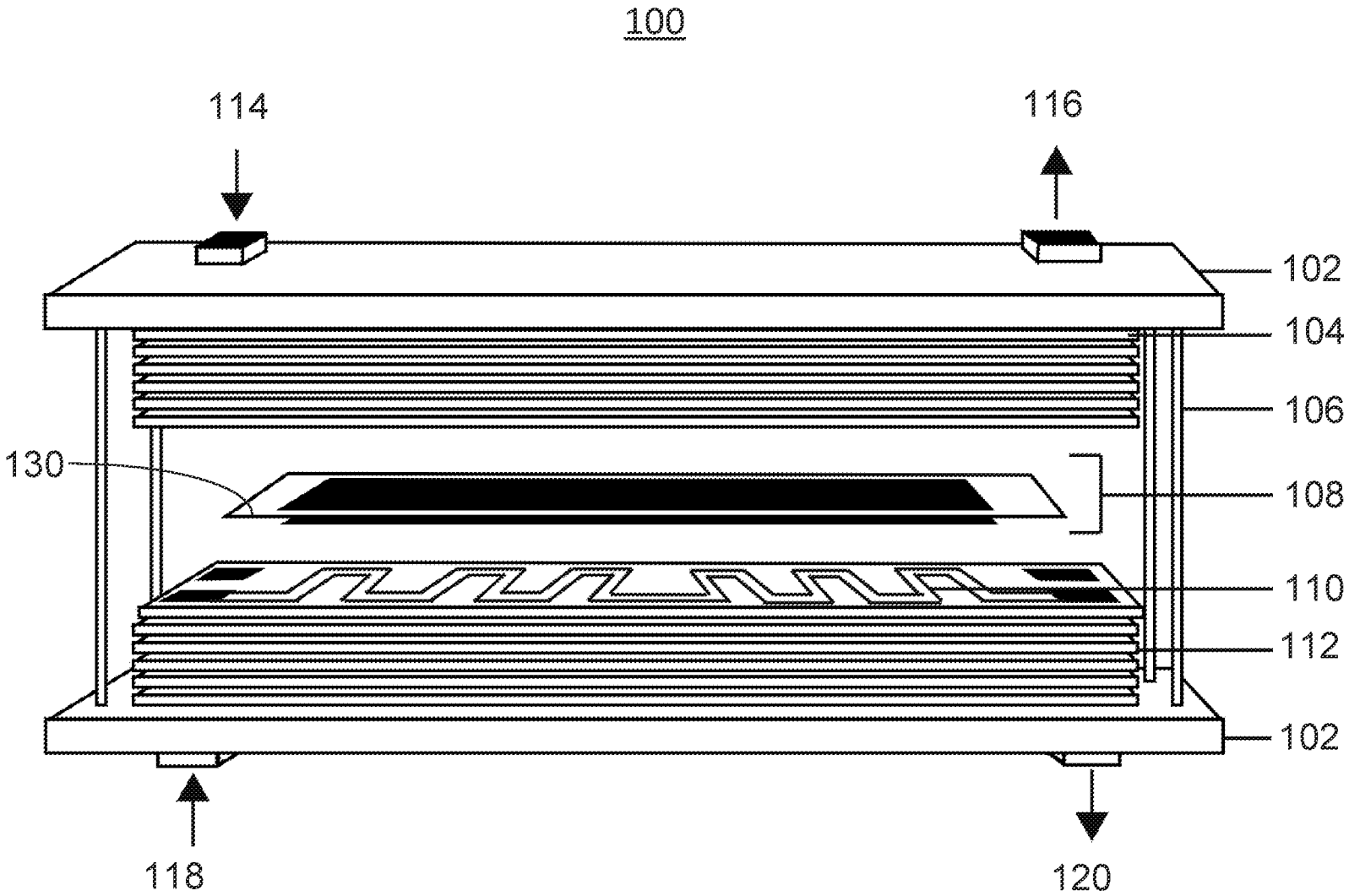
FIG. 1 illustrates an oxocarbon electrolysis reactor that can be utilized in accordance with specific embodiments of the inventions disclosed herein.

The electrolyzers used in accordance with this disclosure can comprise one or more electrocatalytic cells positioned on top or next to one another to increase the surface available for the reaction. They can be stacked on top of one another, and such stacks can also be parallelized. These cells may be connected in series or in parallel. Many different cell and stack configurations can be used for the electrolyzers in accordance with this disclosure. FIG. 1 illustrates an oxocarbon electrolysis reactor 100 that can be utilized in accordance with specific embodiments of the inventions disclosed herein for explanatory purposes. The methods and systems disclosed herein are broadly applicable to oxocarbon electrolyzers generally and oxocarbon electrolysis reactor 100 is provided as a nonlimiting example of one such electrolyzer.

FIG. 1 includes an illustration of an oxocarbon electrolysis reactor 100 in the form of a stack in accordance with specific embodiments of the inventions disclosed herein. The oxocarbon electrolysis reactor 100 includes end plates such as end plate 102, monopolar plates such as monopolar plate 104, rigid bars such as rigid bar 106, a separator and electrode assembly such as electrode assembly 108, a flow field such as flow field 110, and bipolar plates such as bipolar plate 112. Additionally, the oxocarbon electrolysis reactor 100 includes an inlet 114 and an outlet 116 for an anodic stream, as well as an inlet 118 for a cathodic stream and an outlet 120 for the cathodic stream. An oxocarbon can be provided at the inlet 118 in the cathodic stream. The oxocarbon can be humidified. A useful chemical can be provided at outlet 116 in the anodic stream. The polar plates, such as monopolar plate 104 and bipolar plate 112 can be part of the cells in the stack. The stack can also comprise gasketing, sealing of any shape, insulating layers and other materials that have not been represented in the FIG. 1 for clarity.

In an electrolysis stack, subsequent cells can be physically separated by bipolar plates (BPPs), such as bipolar plate 112 in FIG. 1, that can ensure mechanical support for each of the electrolysis cells on each side of the BPP. BPP can also ensure electrical series connection between subsequent electrolysis cells and introduce/remove the reactants/products respectively. At the end of the stack, only one side of the plate can be in contact with the terminal cell; it is then called a monopolar plate, such as monopolar plate 104 in FIG. 1. At the extremities of the stack, current collectors can allow connection to an external power supply, which can also be used, among other elements, for electrical monitoring of the stack. The stack can be assembled within a stack casing allowing its mechanical support and compression, as well as provisioning and transporting the reactant and product streams to and from the stack. The stack casing can comprise end plates that ensure electrical isolation of the stack and provide the inlet and outlets for the reactant and product streams. Alternatively, insulator plates can be placed between the end plate such as end plate 102 and the monopolar plate such as monopolar plate 104 to ensure electrical insulation of the stack versus the stack casing depending on the material of the end plate.

The carbon monoxide electrolyzers can take as an input, a cathodic input stream (e.g., stream enriched in carbon monoxide) and an anode input stream. In such case, the reduction substrate is carbon monoxide. The cathodic input stream can be provided to an inlet such as inlet 118. The anodic input stream can be provided to an inlet such as inlet 114. The cathodic stream and anodic stream can flow through the stack from the inlets to the outlets and be distributed through the flow channels, such as those in flow field 110 of each cell to each cathodic and anodic area separately. The anodic stream and cathodic stream would flow through separate channels on either side of the cell. Alternatively, at least one of the cathodic and anodic streams may be provided to each cell individually instead of through a connection crossing all the plates. In this case, each cell has a dedicated fluid inlet and outlet for this cathodic and/or anodic stream. The nature of the anodic stream can be determined by the nature of the targeted oxidation reaction (such as, but not limited to, water oxidation, dihydrogen oxidation, chloride oxidation, halide oxidation, hydrocarbon oxidation, waste organic oxidation). For example, the generating of chemicals using carbon monoxide and the electrolyzer could involve supplying the volume of carbon monoxide to a cathode area of the electrolyzer as a cathodic input fluid and supplying a volume of water to an anode area of the electrolyzer as an anodic input fluid. When electrically powered, the carbon monoxide electrolyzer carries out the concomitant reduction of carbon monoxide and oxidation of the chosen oxidation substrate to produce added-value chemicals such as hydrocarbons, organic acids and/or alcohols and/or N-containing organic products in the anodic stream.

In specific embodiments of the inventions disclosed herein, the electrolyzer can be operated at elevated temperature and pressure to promote the stability and performance of the electrolyzer by improving oxocarbon mass transport and product efflux. Elevated temperature can serve to evaporate liquid products present in the cathode catalyst layer, while elevated pressure can mitigate the intrusion and retention of liquids in the cathode catalyst layer. In specific embodiments, the electrolyzer can be operated under elevated pressure at both the anode and cathode compartments, or only in one compartment. In embodiments in which the electrolyzer is a mixed liquid and gas phase electrolyzer, elevating pressure in a single compartment could be used to precisely manage liquid and gas crossover in the electrolyzer. In particular, if the separator were a porous separator and the electrolyzer were a mixed liquid and gas phase electrolyzer, a pressure differential could be formed in the electrolyzer to keep the electrolyte pressed away from the gas phase compartment of the electrolyzer.

In specific embodiments of the invention, the electrolyzer can include one or more separators separating the anode area and the cathode area such as separator 130 in the separator and electrode assembly 108. As illustrated, separators such as separator 130 can provide sufficient mechanical stability such that they may serve to support an electrode on both the anode side and cathode side of the electrolyzer. The separation can be conducted to isolate specific generated chemicals from others (e.g., a useful chemical produced at the anode from a byproduct produced at the cathode). The separation can be conducted to provide mechanical stability to the electrolyzer cell in which the separator is used. The separation can be conducted to maintain the different chemistries required for the reduction reaction to occur in the cathode area and the oxidation reaction to occur in the anode area. The separation can also be conducted to prevent short-circuiting contact between anode and cathode layers and prevents crossover of gaseous products generated at the anode and cathode to the opposite electrode. The one or more separators can separate the anode area and the cathode area by being located between the anode area and the cathode area. The electrolyzer may also include a separating area between the anode area and the cathode area configured to separate a volume of generated chemicals from the electrolyzer. The separating area can be isolated from the cathode and/or anode using one or more separators. For example, a first separator could be located at an interface between the separating area and the anode area while another separator could be located at an interface between the separating area and the cathode area. Regardless, as the terms are used herein, a separator "separates the anode area and the cathode area" if it is located at least partly between the cathode area and the anode area. As such, the two separators in the prior example serve to separate the anode area and the cathode area regardless of the fact that each one is not physically in contact with one of the anode area and the cathode area because they are both still located at least partly between the anode area and the cathode area.

As mentioned in the summary above, the separator can be an electroneutral separator. The electroneutral separator can be ionically conductive while still providing high mechanical stability. For example, the electroneutral separator can be strong enough to withstand a pressure differential of 300 mbar without being deformed. The separator can be a porous separator. The separator can be an electroneutral porous separator. The separator can have a conductive electrolyte which fills the pores in the porous separator. The porous electroneutral separator can provide ionic conductivity by having a network of pores that include paths which extend from one side of the separator to the other side of the separator through the network of pores. This ionic conductivity can be provided by a conductive electrolyte which fills the network of pores. Further details regarding the separators and their properties are provided in detail below.

As mentioned above, the oxocarbon electrolyzers can be used to produce useful chemicals. An oxocarbon electrolyzer in accordance with specific embodiments disclosed herein can include a cathode area where carbon oxide (e.g., carbon dioxide and/or carbon monoxide) reduction takes place, according to equation 1 and 2 below, and an anode area where an oxidation reaction takes place on an oxidizing catalyst. The oxidation substrate can be water, dihydrogen gas, halides, organic waste or any other oxidation substrate. For example, the oxidation can involve water oxidation or dihydrogen oxidation according to equations 3 and 4 below respectively.

$$x\,CO_2 + y\,H_2O + ze^- \rightleftharpoons C_xH_{(2y-z)}O_{(2x+y-z)} + zOH^- \quad (1)$$

$$x\,CO + (x+y-z)\,H_2O + (2x+y-2z)\,e^- \rightleftharpoons C_xH_yO_z + (2x+y-2z)\,OH^- \quad (2)$$

$$2\,H_2O \rightleftharpoons 4\,H^+ + 4\,e^- + O_2 \quad (3)$$

$$H_2 \rightleftharpoons 2\,H^+ + 2\,e^- \quad (4)$$

The reactions below can be conducted in accordance with the electrolyzers described herein. In the diagrams provided herein, only single cells are represented for clarity but these could be assembled in a plurality of cells, such as in an electrolyzer stack. In the diagrams, a carbon oxide electrolyzer comprises a cathode comprising a gas-diffusion layer and a cathode catalyst, and the anode comprises an anode catalyst deposited on a transport layer of any shape (such as but not limited to a foam, a mesh, a deposit onto a conductive porous transport layer (PTL), etc.). In this case, the carbon oxide reduction products include one or more of the following: carbon monoxide (CO), syngas ($CO^+H_2$), ethylene ($C_2H_4$), ethanol ($C_2H_5OH$), acetic acid ($CH_3COOH$), propylene ($C_3H_6$), propanol ($C_3H_8O$), oxalic acid (COOH—COOH), acrylic acid ($C_2H_3COOH$), glyoxylic acid (COH—COOH) produced according to the following reduction reactions. In neutral/alkaline conditions for $CO_2$ reduction:

$$CO_2+H_2O+2e^- \rightarrow CO+2\,OH^- \quad (5)$$

$$2CO_2+8H_2O+12e^- \rightarrow CH_2CH_2+12OH^- \quad (6)$$

$$2CO_2+9H_2O+12e^- \rightarrow CH_3CH_2OH+12OH^- \quad (7)$$

$$2CO_2+6H_2O+8e^- \rightarrow CH_3COOH+{}_8OH^- \quad (8)$$

$$3CO_2+12H_2O+16e^- \rightarrow C_2H_3COOH+16OH^- \quad (9)$$

$$3CO_2+12H_2O+18e^- \rightarrow C_3H_6+18OH^- \quad (10)$$

$$3CO_2+13H_2O+18e^- \rightarrow C_3H_8O+18OH^- \quad (11)$$

In neutral/alkaline conditions for CO reduction:

$$2CO+6H_2O+8e^- \rightarrow CH_2CH_2+8OH^- \quad (12)$$

$$2CO+7H_2O+8e^- \rightarrow CH_3CH_2OH+8\,OH^- \quad (13)$$

$$2CO+4H_2O+4e^- \rightarrow CH_3COOH+4OH^- \quad (14)$$

$$3CO+5H_2O+6e^- \rightarrow C_2H_3COOH+6\,OH^- \quad (15)$$

$$3CO+9H_2O+12e^- \rightarrow C_3H_6+12\,OH^- \quad (16)$$

$$3CO+10H_2O+12e^- \rightarrow C_3H_8O+12OH^- \quad (17)$$

The electrode may also generate syngas, a mixture of $H_2$ and CO through a concomitant production of $H_2$ through reaction 18 with reaction 5.

$$2H_2O+2e^- \rightarrow H_2+2OH^- \quad (18)$$

In tandem, the anode carries out an oxidation reaction from the group of reactions such as but not limited to:

$$4OH^- \rightarrow 2+2H_2O+4e^- \quad (19)$$

$$H_2+2OH^- \rightarrow 2H_2O+2e^- \quad (20)$$

$$Cl^- \rightarrow Cl_2+2e^- \quad (21)$$

$$Br^- \rightarrow Br_2+2e^- \quad (22)$$

$$I^- \rightarrow I_2+2e^- \quad (23)$$

$$C_3H_8O_3(\text{glycerol})+2OH^- \rightarrow C_3H_6O_3(\text{glyceraldehyde})+2H_2O+2e^- \quad (24)$$

$$C_3H_8O_3(\text{glycerol})+5OH^- \rightarrow C_3H_5O_4(\text{glycerite})+4H_2O+4e^- \quad (25)$$

$$C_3H_8O_3(\text{glycerol})+13/2OH^- \rightarrow 3/2C_2H_3O_3^-+5H_2O+5e^- \quad (26)$$

$$C_3H_8O_3(\text{glycerol})+11OH^- \rightarrow 3HCOO^-(\text{formate})+8H_2O+8e^- \quad (27)$$

$$C_3H_8O_3(\text{glycerol})+14OH^- \rightarrow 3/2C_2O_4^{2-}+11H_2O+11e^- \quad (28)$$

These reactions are assisted catalytically by the presence of metal cations, such as, but not exclusively $Li^+$, $Na^+$, $K^+$, $Rb^+$, $Cs^+$, $Fr^+$. The presence of these cations can be enabled through the liquid phase of the reactor, which is typically introduced at the anode area, but may be introduced at a central separator or cathode area of the reactor. These cations can reach the cathode catalyst layer via diffusion across an electroneutral separator between the anode area and the cathode area. At the same time, an electroneutral separator can allow the ions from the reduction and/or oxidation reactions occurring at the electrolyzer's catalytic electrodes to be transferred across the electrolyzer (e.g., ions such as $H^+$, $CO_3^{2-}$, $OH^-$, or $HCO_3^-$ can migrate across the separator).

Figure 2:
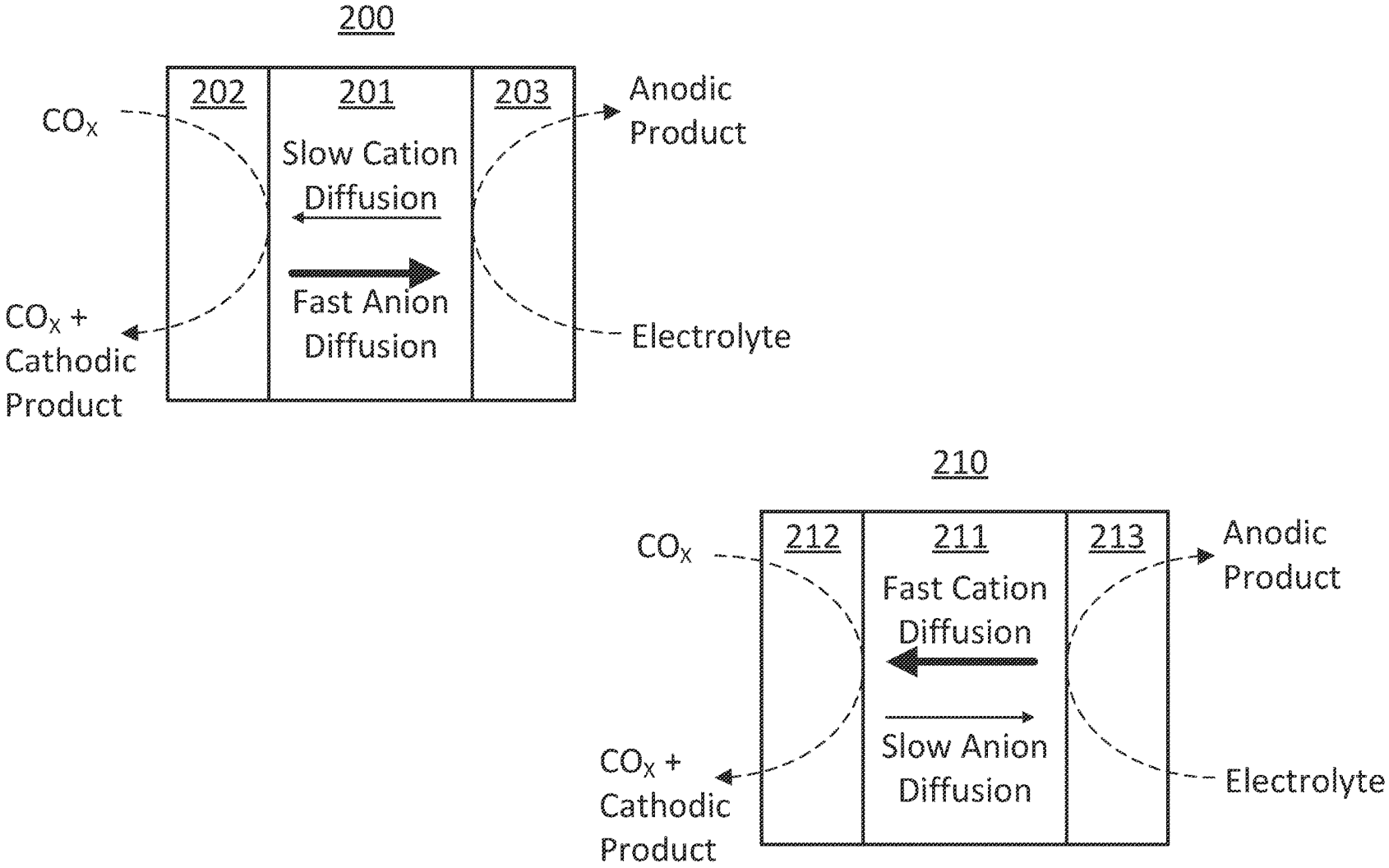
FIG. 2 (Related Art)
FIG. 2 includes two block diagrams of electrolysis reactors in accordance with the related art.
Figure 3:
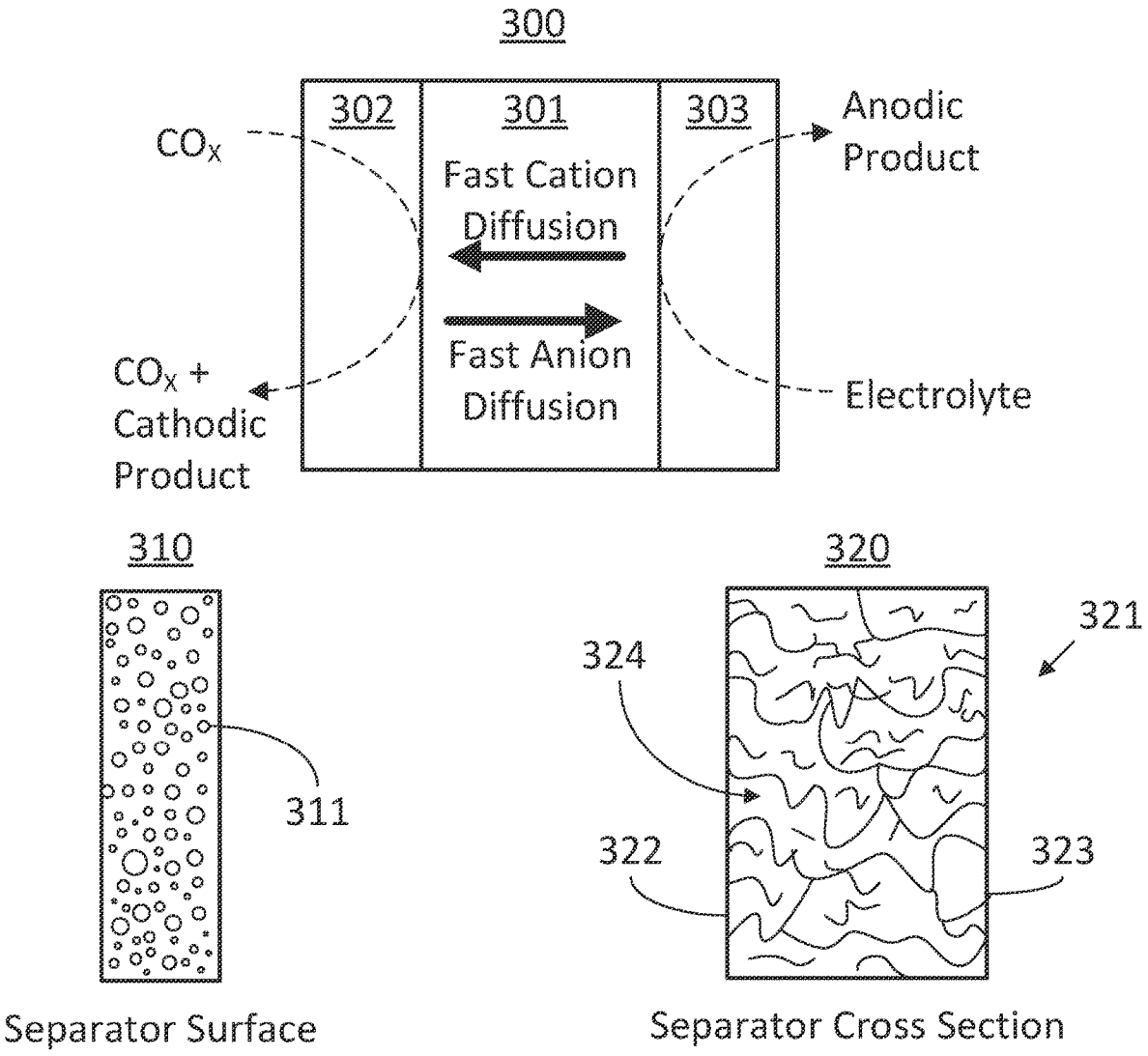
FIG. 3 includes a block diagram of an electrolysis rector with a porous electroneutral separator and two illustrations of a separator in accordance with specific embodiments of the inventions disclosed herein.

In specific embodiments of the invention, a separator in accordance with this disclosure allows for indiscriminate movement of ions across the separator through a network of pores. The network of pores may include a network of submillimeter interconnected pores forming paths through the separator. The network of pores may be formed by an insulating material that provides the structure of the separator which form an insulating network containing for example, carbon, oxygen, fluorine, hydrogen, silicon and nitrogen bonds. These pores accumulate liquid electrolyte that allows the flow of both anions and cations to the anode area and cathode area respectively. Unlike ion exchange membranes this leads to a separator that does not hinder the flow of a particular ionic species. Such an alternative is illustrated by electrolyzer 200 in FIG. 2 having an anion exchange membrane 201 separating a cathode area 202 from an anode area 203 and electrolyzer 210 having a cation exchange membrane 211 separating a cathode area 212 from an anode area 213. This can be contrasted with the electrolyzer 300 in FIG. 3 where an electroneutral separator 301 allows for the facile migration of both anions and cations between cathode area 302 and anode area 303. In the illustrated electrolyzer diagrams dotted arrows represent electrochemical conversions while solid arrows represent ionic diffusion. FIG. 3 also includes a separator surface view 310 which shows a set of pores including pore 311 and a cross section of the separator 320 showing a porous network 321 formed by the set of pores and extending through the separator from an anode side 322 to a cathode side 323. The network includes a set of paths such as path 324 that extend from the anode side to the cathode side.

The pores in the separator can take on various forms in different embodiments of the invention. In specific embodiments of the invention, a porous separator works by providing optimally sized pores in which electrolyte may be trapped to allow ion flux in both directions across the electrolyzer. In specific embodiments, this functionality enables the diffusion of alkali metal cations to accumulate at the cathode catalyst of the electrolyzer which are used by the cathode catalyst to undertake oxocarbon reduction. The pores also allow the flow of anions that are generated from the reduction reaction at the cathode to flow to the anode. The pores in the separator can be regularly spaced or irregularly spaced depending upon how they are formed. The pores can be various sizes as set by the desired mechanical stability and ionic conductivity of the separator. The pores in the set of pores can be submillimeter scale and each have less than one millimeter in diameter. The pores can be micron scale pores. The pores can be as small as 200 nanometers or smaller. The pores can be exposed on the surface of the separator such that when the separator is brought into contact with a liquid, such as a conductive electrolyte in the anode area or cathode area of the electrolyzer, the liquid fills the pores and thereby extends through the porous separator via the porous network. In embodiments in which the pores form a porous network, the network can be filled with a conductive electrolyte.

In specific embodiments of the invention, a porous sheet of natural, synthetic or semisynthetic polymeric material is used as the separator. In specific embodiments, the separators will be electroneutral separators that do not include any charged particles implanted into the material (e.g., polymer(s)) used to form the separator. The separator can be formed of various polymeric materials such as, but not exclusively, polytetrafluoroethylenes, polyethylenes polypropylenes, polystyrenes, polysiloxanes, polyether sulfone, polacrylonitrile, polyacrylates, polyimides, polycarbonates or cellulose acetates or any mixture thereof. The separator can be formed of a polymer composed of one or more monomers selected from a group consisting of: tetrafluoroethylenes, ethylenes, propylenes, polystyrenes, polysiloxanes, polacrylonitrile, polyacrylates, sulfones, polyimides, polycarbonates and cellulose acetates. The separator may also include porous ceramic materials and/or a mixture of polymeric and ceramic materials. These polymers can be fabricated into thin films containing pores on the submillimeter scale. The polymers may be used alone or may be copolymerized with other materials to attain the desired structural and mechanical properties for a given electrolyzer. The separator can be a polymer formed by chain growth polymerization of one or more monomers selected from a group consisting of: vinyls, olefins, styrenes, acrylates, methacrylates, acrylamides, methacrylamides, epoxides, lactones, lactams, siloxanes, sulfones, and carbonates. The separator can be a polymer formed by step growth polymerization of one or more chemicals selected from a group consisting of multifunctional alcohols, amines, thiols with one or more multifunctional carboxylic acids, acid halides, alkyl halide, esters, isocyanates, aldehydes, ketones, anhydrides.

In specific embodiments of the invention, the polymeric separator may be functionalized with a coating to render the separator more hydrophobic or hydrophilic, through functionalization with organic or inorganic additives. The coating can increase the hydrophilicity or hydrophobicity of the separator. The coating can be an uncharged polymer, a nonionic surfactant, a wax, an alcohol, an amine, a thiol, an ether, an ester, an amide, a nitrile, an imide, a phosphine or a mixture thereof. The separators may also be adorned with catalyst particles or other transition metal species both inside and on the outer faces of the separator to facilitate charge and ion transfer reactions and the electrolyzer's catalytic interfaces. Coating of the separator may be achieved through a technique such as doctor blading, electrospinning, spin coating, evaporation, drop casting, or by immersing the separator into a liquid form of solution of the species to be coated. In some cases, the coating may be necessary for the separator to function in the carbon oxide electrolyzer.

In specific embodiments of the invention, the separators are thin sheets. The thickness of the separator can be chosen to control the transport rates of species such as anions, cations, and neutral species such as alcohols and water during operation of the electrolysis reactor in which they are installed. Pore size can be selected along with thickness to impact this rate. Generally, for high efficiency reactors faster ionic migration is preferred such that thinner separators are preferred. The sheets can be less than 250 microns (μm) in thickness, may advantageously be less than 200 μm in thickness, less than 100 μm in thickness, and ideally may be less than 50 μm in thickness where the thickness is measured from the anode area to the cathode area. The thinness of the sheet is limited by the mechanical stability of the sheet for a given application and the ability of the sheet to maintain its function as a separator in keeping the chemistries of the anode area and the cathode area separate aside from the allowance of ionic migration across the separator.

In specific embodiments of the invention, the separator is pressed against a cathode area that comprises a catalyst layer able to reduce a substance (e.g., carbon monoxide or carbon dioxide) to generate value-added hydrocarbons/alcohols/organic acids or carboxylates. The catalyst can comprise one or more: molecular species, single-metal-site heterogeneous compounds, metal compounds, carbon-based compounds, polymer electrolytes (also referred to as ionomers), metal-organic frameworks, or metal-doped covalent organic frameworks or any other additives. The molecular species can be selected from metal porphyrins, metal phthalocyanines or metal bipyridine complexes. The metal compound can be under the form of metal nanoparticles, nanowires, nano powder, nanoarrays, nanoflakes, nanocubes, dendrites, films, layers or mesoporous structures. The single-metal-site compounds can comprise a metal-doped carbon-based material or a metal-N—C-based compound. The cathode catalyst may be made of a metal or metal ion from metals such as, but not limited to, Cu, Ag, Au, Zn, Sn, Bi, Ni, Fe, Co, Pd, Ir, Pt, Mn, Re, Ru, La, Tb, Ce, Dy or other lanthanides and mixtures and/or alloys thereof. For example, the cathodic catalyst could comprise Cu such that the electrolyzer assembly included a copper-based cathode. The carbon-based compounds can comprise carbon nanofibers, carbon nanotubes, carbon black, graphite, boron-doped diamond powder, diamond nanopowder, boron nitride or a combination thereof. The additives can be halide-based compounds including $F^-$, $Br^-$, $I^-$, and $Cr^-$. The additives can be specifically dedicated to modifying hydrophobicity such as treatment with PTFE or carbon black. The cathode area may further comprise a catalyst layer on a gas diffusion layer, a porous transport layer, or any other support, which encourages the diffusion of the gas from a stream to the surface of the catalyst, as well as allowing the release of non-reacted/product gases. Porous transport layers can also be referred to herein as porous supports.

In specific embodiments of the invention, the separator is pressed against an anode area that comprises an anodic catalyst layer able to oxidize a substance to produce a product and protons/water. The catalyst can comprise one or more: molecular species, single-metal-site heterogeneous compounds, metal compounds, carbon-based compounds, polymer electrolytes (also referred to as ionomers), metal-organic frameworks, metal-doped covalent organic framework or any other additives. The molecular species can be selected from metal porphyrins, metal phthalocyanines or metal bipyridine complexes. The metal compound can be under the form of metal nanoparticles, nanowires, nano powder, nanoarrays, nanoflakes, nanocubes, dendrites, films, layers or mesoporous structures. The single-metal-site compounds can comprise a metal-doped carbon-based material or a metal-N—C-based compound. Anodic catalyst species used for this purpose could include, but are not limited to, metals and/or ions of: Jr, Co, Cu, Ni, Fe, Pt, Rh, Re, Ru, Pd, Os, Mo and mixtures and/or alloys thereof. For example, the anodic catalyst could be Ni such that the electrolyzer assembly included a nickel-based anode. The carbon-based compounds can comprise carbon nanofibers, carbon nanotubes, carbon black, graphite, boron-doped diamond powder, diamond nanopowder, boron nitride or a combination thereof. The additives can be halide-based compounds including F, Br, I, and Cl. The additives can be specifically dedicated to modifying hydrophobicity such as treatment with PTFE or carbon black. The anode area may further comprise a catalyst layer on a gas diffusion layer, a porous transport layer, or any other support, which encourages the diffusion of the gas from a stream to the surface of the catalyst, as well as allowing the release of product gases.

In specific embodiments of the invention, the porous support for either the anode area, the cathode area, or both, can be selected from carbon-based porous supports or metal-based porous material or a combination. The carbon-based porous support can be based on carbon fibers, carbon cloth, carbon felt, carbon fabric, carbon paper, molded graphite laminates and the like or a mixture thereof. The carbon-based porous support can be a gas diffusion layer with or without microporous layer. Such carbon-based support can be in particular chosen in the among the following list: Sigracet 39AA, Sigracet 39BC, Sigracet 39BB, Sigracet 39BA, Sigracet 36AA, Sigracet 36BB, Sigracet 35BC, Sigracet 35BA, Sigracet 29BA, Sigracet 28BB, Sigracet 28AA, Sigracet 28BC, Sigracet 25BC, Sigracet 22BB, Sigracet 35BI, Toray papers, Toray THP-H-030, Toray TGP-H-060, Toray TGP-H-090, Toray TGP-H-120, Freudenberg H23C6, Freudenberg H15C13, Freudenberg H15C14, Freudenberg H14C10, Freudenberg H14CX483, Freudenberg H14CX653, Freudenberg H23C2, Freudenberg H23CX653, Freudenberg H24CX483, Freudenberg H23C6, Freudenberg H23C8, Freudenberg H24C5, Freudenberg H23C3, Avcarb MB-30, Avcarb GDS5130, Avcarb GDS2130, Avcarb GDS3250, Avcarb GDS3260, Avcarb GDS2230, Avcarb GDS2240, Avcarb GDS2255, Avcarb GDS2185, AvCarb 1071, AvCarb 1698, AvCarb1209, AvCarb 1185, AvCarb1186, AvCarb 7497, AvCarb T1819, AvCarb T1820, AvCarb T1824, AvCarbon 1071, AvCarb 1698, AvCarb 1209, AvCarb 1185, AvCarb 1186, AvCarb 1186, AvCarb T1819, AvCarb T1820, AvCarb T1824, AvCarb EP40, AvCarb P75, AvCarb EP55, AvCarbon EP40T, AvCarb P75T, AvCarb EP55T, AvCarb MGL190, AvCarb MGL280, AvCarbMGL370. The metal-based porous support can be selected from titanium, stainless steel, Ni, Cu or any other suitable metal and can be under the form of mesh, frit, foam or plate of any thickness or porosity.

In specific embodiments of the electrolyzer, the high mechanical strength of the separator is exploited in the deposition of catalyst layers onto the separator. In these embodiments, the cathode catalyst layer, the anode catalyst layer, or both are applied directly onto the separator through techniques such as reactive spray deposition, ultrasonic spraying, air brushing, brushing, drop-casting, spin coating, electrospinning, or through transfer from an ink-loaded support. The separator may be hot-pressed to encourage interaction between the applied catalysts and the separator.

In specific embodiments of the invention, the system can include an electrolyte that will facilitate the transportation of ions and provide ions that promote the reactions. In some embodiments of the technology, the electrolyte may be an alkaline solution such as a solution of hydroxide-containing salt such as but not limited to potassium, sodium or cesium hydroxide with concentrations such as (0.01 molarity (M), 0.05 M, 0.1 M, 0.2 M, 0.5 M, 1 M, 2 M, 3 M, 4 M, 5 M, 6 M, 7 M, 8 M, 9 M and 10 M). The use of concentrated alkaline solution brings down the energy requirement of the overall reaction. Alkali metal cations (such as Li, Na, K, Cs, Rb) may be used as counter-cations. In other embodiments of the reactor, the electrolyte may contain salt with cations such as $Li^+$, $K^+$, $Na^+$, $Cs^+$, $Rb^+$, $Fr^+$, with anions including, but are not limited to $HCO_3^-$, $CO_3^{2-}$, $Cl^-$, $Br^-$, $I^-$, $OH^-$, $ClO_4^-$, $IO_4^-$, $SO_4^{2-}$, $NO_3^-$. The anion may be oxidized during electrolysis. Given that the conductivity of the system is determined by the electrolyte, changes to electrolyte composition and concentration has considerable influence on the voltage/current characteristics and selectivity of the device. The electrolyte may be introduced through the anodic chamber, the cathodic chamber or be applied directly to the separator through a separate inlet. In specific embodiments of the invention, the electrolyzer is used for the production of high-added-value products from carbon monoxide, such as but not exclusively, acetate, ethanol, ethylene, propanol and propionate. The electrolyte in these embodiments can be hydroxide based. In specific embodiments of the invention, the electrolyzer is used for the production of high-added-value products from carbon dioxide, such as but not exclusively carbon monoxide, syngas, formic acid, acetic acid, ethanol, ethylene, propanol and propionate. The electrolyte in this embodiment can be based on an alkali metal carbonate or alkali metal bicarbonate, such as $K_2CO_3$, $KHCO_3$, $Na_2CO_3$, $NaHCO_3$, $Li_2CO_3$, $LiHCO_3$, $Cs_2CO_3$, $CsHCO_3$ or a mixture thereof.

The electrolyte can be applied to the electrolyzer in various ways. In specific embodiments of the invention, an electrolyte input feeds electrolyte directly to the separator. The electrolyte can be delivered directly to the separator in this example by extending the separator beyond the edges of the reactor cell to which it is a part and allowing electrolyte to be absorbed into the separator through capillary forces. In alternative embodiments of the invention, an electrolyte input flows electrolyte through a cathodic input stream or an anodic input stream and the electrolyte is applied to the separator via the fact that the separator is in contact with the anode area or cathode area. The electrolyzers can take as an input, a cathodic input stream (e.g., stream enriched in carbon monoxide or dioxide) and an anode input stream. The cathodic input stream can be provided to an inlet connected to the cathode flow field. The anodic input stream can be provided to an inlet connected to an anode flow field. The cathodic stream and anodic stream can flow through the stack from the inlets to the outlets and be distributed through the flow channels to each cathodic and anodic area separately. The anodic stream and cathodic stream can flow through separate channels on either side of the cell. Alternatively, at least one of the cathodic and anodic streams may be provided to each cell individually instead of through a connection crossing all the plates. In this case, each cell has a dedicated fluid inlet and outlet for this cathodic and/or anodic stream. The nature of the anodic stream can be determined by the nature of the targeted oxidation reaction (such as, but not limited to, water oxidation, dihydrogen oxidation, chloride oxidation, halide oxidation, hydrocarbon oxidation, waste organic oxidation). When electrically powered, the carbon oxide electrolyzer carries out the concomitant reduction of carbon oxide and oxidation of the chosen oxidation substrate to produce added-value chemicals such as hydrocarbons, organic acids and/or alcohols and/or N-containing organic products in the output cathodic stream separated from the anodic stream where the oxidation products are specifically collected. For example, the generating of chemicals using carbon oxide and the electrolyzer could involve supplying the volume of carbon oxide to a cathode area of the electrolyzer as a cathodic input fluid and supplying a volume of electrolyte to an anode area of the electrolyzer as an anodic input fluid.

In specific embodiments, the electrolyzer operates with a pressure drop from the cathode to the anode to encourage the diffusion of certain species away from the cathode catalyst layer. In other embodiments the electrolyzer operates at a high absolute pressure to encourage solubilization of substrate carbon oxide gas across the system. The use of a pressure drop across the reactor is advantageous for the following reasons: 1) the gaseous phase of the electrolyzer may be compressed to increase the availability of carbon oxide; 2) the pressure may be used to control the proportion of liquid water available at the catalytic interfaces; 3) the pressurization can be used to force certain species across the electrolyzer, such as the products of electrolysis or the carbon oxide substrate. The differential pressure can be used to control the presence of liquid water, electrode and carbon oxide gas at the interface between anode and cathode which may concomitantly lead to superior catalyst selectivity, efficiency or stability, or all three.

In accordance with specific embodiments of the inventions disclosed herein, the separator has enhanced mechanical stability compared to prior art approaches and is therefore conducive to increased pressure. This allows larger differential pressures to be held across the oxocarbon electrolyzer. This pressure differential may be greater than 200 mbar, may ideally be a greater than 500 mbar pressure differential, and may be greater than 1 bar pressure differential. However, at increasing pressure, the stability of the separator may become too intense of a constraint and limit the flexibility of the design to have an increased number of pores, an increased size of pores, or place a limit on how thin the separator can be made.

Figure 4:
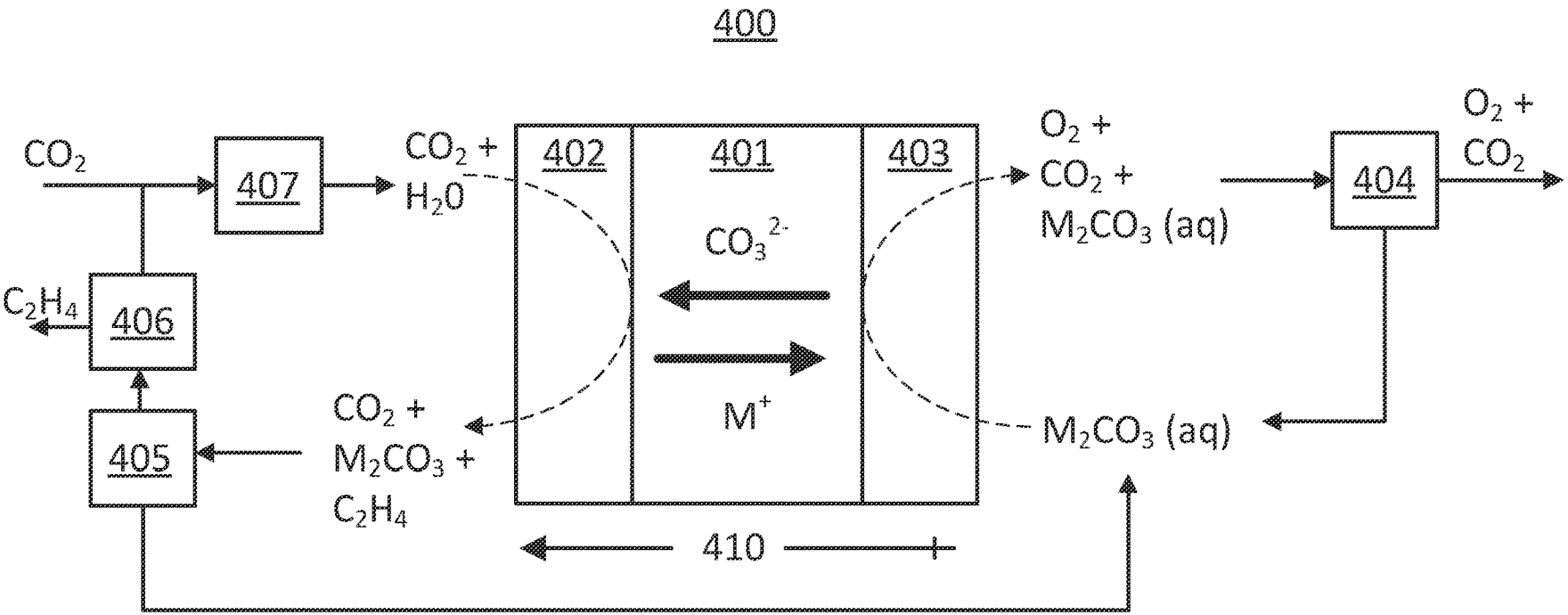
FIG. 4 includes a block diagram of a carbon dioxide electrolysis reactor in accordance with specific embodiments of the inventions disclosed herein.

FIG. 4 provides a block diagram 400 of an electrolyzer for reducing carbon dioxide to ethylene, acetate, or other multi-carbon products. In the figure, dotted arrows represent electrochemical conversion and solid arrows represent chemical movement. Block diagram 400 includes a reactor with a cathode area 402, an anode area 403, and a separator 401 in accordance with the electroneutral porous separators described herein. In this example, the anode area 403 is aqueous and the cathode area 402 is gaseous. The reactor includes a pressure differential 410 with increased pressure on the cathode side. As a result, the pressure pushes against the liquid electrolyte and keeps it from leaking through the separator. The pressure can be tuned to assure that the separator remains saturated with liquid electrolyte while not leaking an unacceptable amount of electrolyte. Furthermore, using the illustrated approach, any electrolyte that does seep through the separator can be recovered and recycled. Block diagram 400 also includes a gas/liquid separator 404, a gas/liquid separator 405, a carbon dioxide separator 406, and a humidifier 407. In this example, the technology is used to reduce $CO_2$ to ethylene while generating a stream of $O_2$ through the oxidation of $H_2O/OH^-$. An alkali metal carbonate electrolyte ($M_2CO_3$) is supplied to the anode and ensures that a good supply of alkali metal cation is present. The cathode is a gas diffusion layer with a catalyst layer of copper particles and the anode is a porous transport layer coated with iridium oxide nanoparticles. The separator 401 is an electroneutral porous separator in the form of a hydrophilic polytetrafluoroethylene sheet with pores <0.2 μm in size and a thickness below 50 μm. At the cathode, humidified $CO_2$ is introduced where it diffuses to the cathode catalyst and is reduced to ethylene (or other multi-carbon products). This reaction is promoted by the presence of the alkali metal cations in the non-charged polymeric separator and produces hydroxide along with the product.

$$2CO_2+8H_2O+12e^-\rightarrow C_2H_4+12OH^- \quad (29)$$

The hydroxide formed subsequently reacts with a second molecule of $CO_2$ to generate a bicarbonate/carbonate ion:

$$CO_2+OH^-\rightarrow HCO_3^- \quad (30)$$

$$HCO_3^-+OH^-\rightarrow CO_3^{2-}+H_2O \quad (31)$$

The generated carbonate may then be removed from the reactor as a stream of concentrated alkali metal carbonate in the cathodic product outlet where it can be separated from the gaseous products.

$$CO_3^{2-}+2M^+\rightarrow M_2CO_3 \quad (32)$$

Alternatively, the carbonate may travel across the non-charged polymeric separator to the anode. At the anode the anodic reaction generates $O_2$ from the oxidation of water, as well as protons. The production of protons leads to the protonation of the carbonate anions to produce $CO_2$ and water. The $CO_2$ and $O_2$ that form are then released through the anodic chamber.

$$2CO_3^{2-}+2H^+\rightarrow 2CO_2+2OH^- \quad (33)$$

$$2OH^-\rightarrow O_2+2H^++4e^- \quad (34)$$

Figure 5:
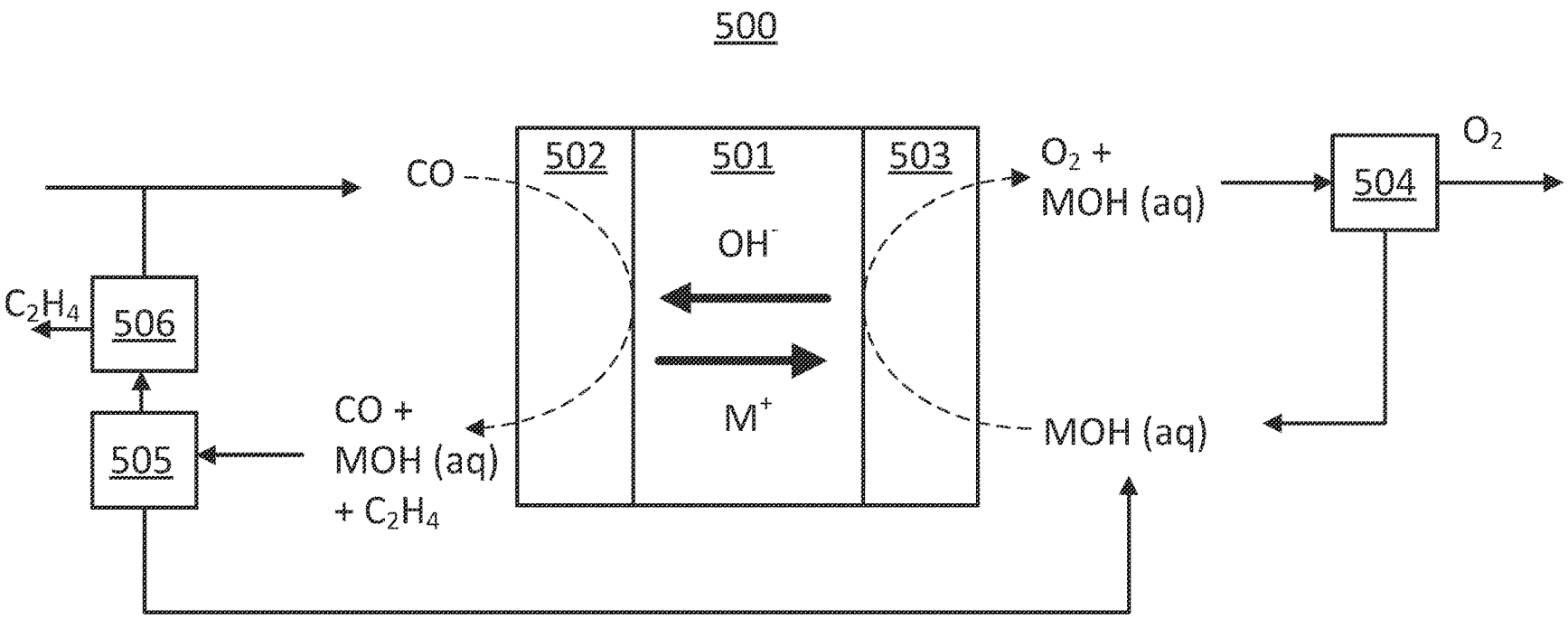
FIG. 5 includes a block diagram of a carbon monoxide electrolysis reactor in accordance with specific embodiments of the inventions disclosed herein.

FIG. 5 provides a block diagram 500 of an electrolyzer for reducing carbon monoxide to ethylene, acetate, or other multi-carbon products. In the figure, dotted arrows represent electrochemical conversion and solid arrows represent chemical movement. Block diagram 500 includes a reactor with an anode area 503, a cathode area 502, and a separator 501 in accordance with the electroneutral porous separators described herein. In this example, the anode area 503 is aqueous and the cathode area is gaseous. Block diagram 500 includes a gas/liquid separator 504, a gas/liquid separator 505, and a carbon monoxide separator 506. In this example, the electrolyzer is used for the reduction of pure carbon monoxide. The cathode is a gas diffusion layer with a catalyst layer of copper particles and the anode is a nickel porous transport layer. At the cathode, carbon monoxide is introduced where it diffuses to the cathode catalyst and is reduced to ethylene and/or ethanol (or other multi-carbon products). In this example, the electroneutral polymeric separator is a hydrophilic polytetrafluoroethylene sheet with pores <0.2 μm in size and a thickness below 50 μm. This reaction is promoted by the presence of the alkali metal cations in the electrolyte-filled separator and produces hydroxide along with the ethylene and/or acetate.

$$2CO+6H_2O+8e^-\rightarrow C_2H_4+8OH^- \quad (35)$$

$$2CO+4H_2O+4e^-\rightarrow CH_3COOH+4OH^- \quad (36)$$

The hydroxide formed above may be removed from the reactor as a stream of concentrated alkali metal hydroxide in the cathodic product outlet. Otherwise, the hydroxide travels across the electroneutral polymeric separator to the anode. At the anode the anodic reaction generates oxygen gas from the oxidation of water, as well as water. The anodic oxygen gas escapes through the anodic product stream.

$$4OH^-\rightarrow O_2+2H_2O+4e^- \quad (37).$$

The ethylene produced is collected in the gas outlet of the cathodic reactor along with unreacted carbon monoxide. The acetate is either collected in the cathodic compartment as a concentrated alkali metal acetate, or transferred to the anode, where it is collected from the electrolyte. The movement of acetate may be controlled using the pressure drop of the electrolyzer and separator pore size.

Figure 6:
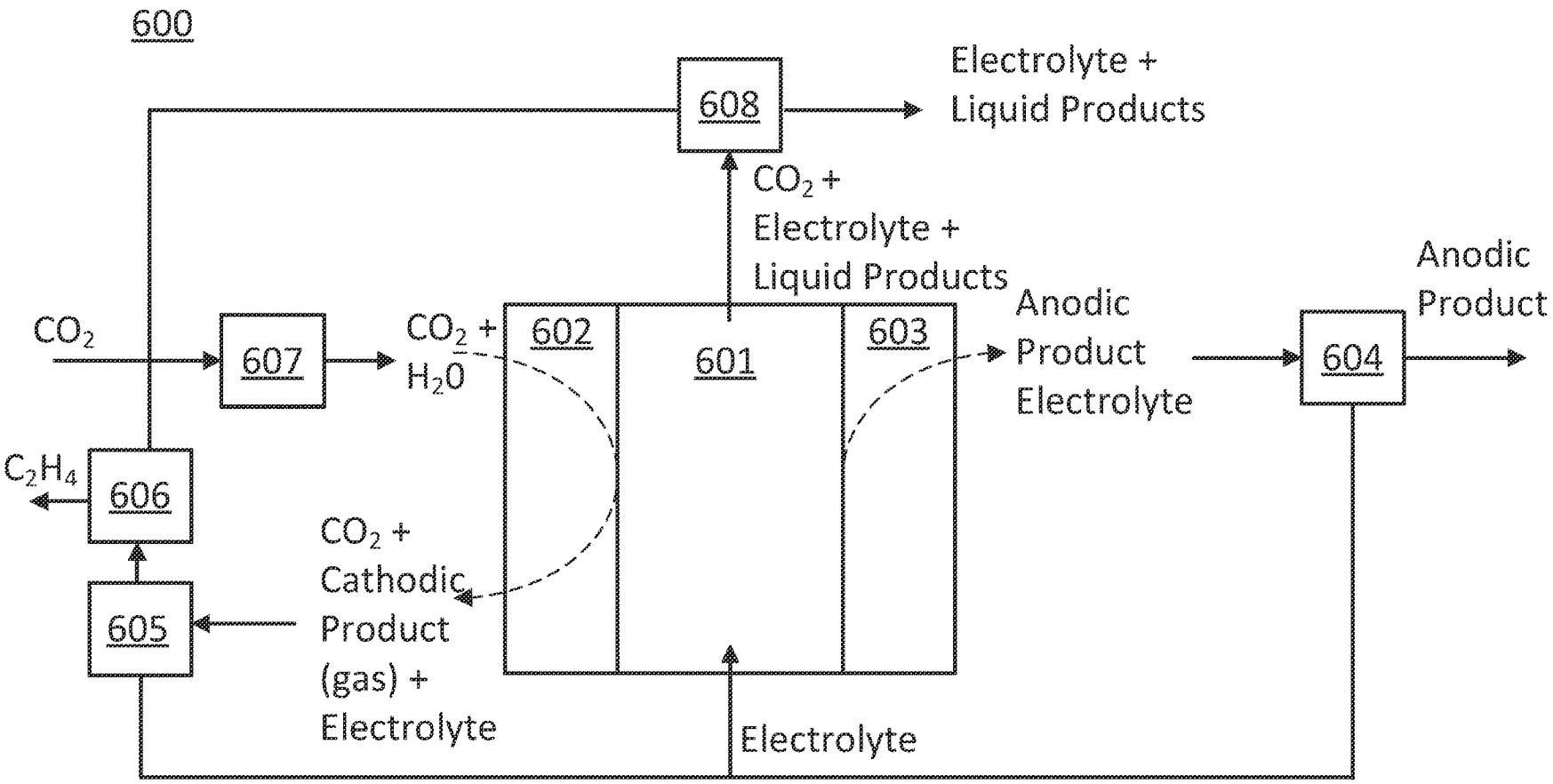
FIG. 6 includes a block diagram of an electrolysis reactor where an electrolyte is applied directly to a separator in accordance with specific embodiments of the inventions disclosed herein.

FIG. 6 provides a block diagram 600 of an electrolyzer for reducing carbon monoxide or carbon dioxide to, for example: ethylene, ethanol, propylene, propanol, carbon monoxide or syngas (and potentially other co-products). In the figure, dotted arrows represent electrochemical conversion and solid arrows represent chemical movement. Block diagram 600 includes a reactor with an anode area 603, a cathode area 602, and a separator 601 in accordance with the electroneutral porous separators described herein and with corresponding water and electrolyte management while introducing the electrolyte through the separator. In this example, the anode area 603 is aqueous and the cathode area is gaseous. Block diagram 600 includes a gas/liquid separator 604, a gas/liquid separator 605, an oxocarbon separator 606, a humidifier 607, and a gas/liquid separator 608. In this example, an alkali metal-based salt, or similarly acting alternative, can be used to ensure high ionic conductivity across the cell and is introduced directly into the system through the non-charged polymeric separator. The advantage of this approach is that the flow through the separator may be used to isolate the products crossing the non-charged ionic separator that would otherwise be mixed with products at the anode or cathode. This could be used to mitigate the release of carbon dioxide in the anodic chamber of a carbon dioxide electrolyzer after carbonate acidification:

$$2CO_3^{2-}+2H^+\rightarrow 2CO_2+2OH^- \quad (38)$$

In this example, the electroneutral polymeric separator is a hydrophilic polytetrafluoroethylene sheet with pores <0.2 μm in size and a thickness below 50 μm. The electrolyte can be delivered directly to the separator in this example by extending the separator beyond the edges of the reactor cell to which it is a part and allowing electrolyte to be absorbed into the separator through capillary forces.

Figure 7:
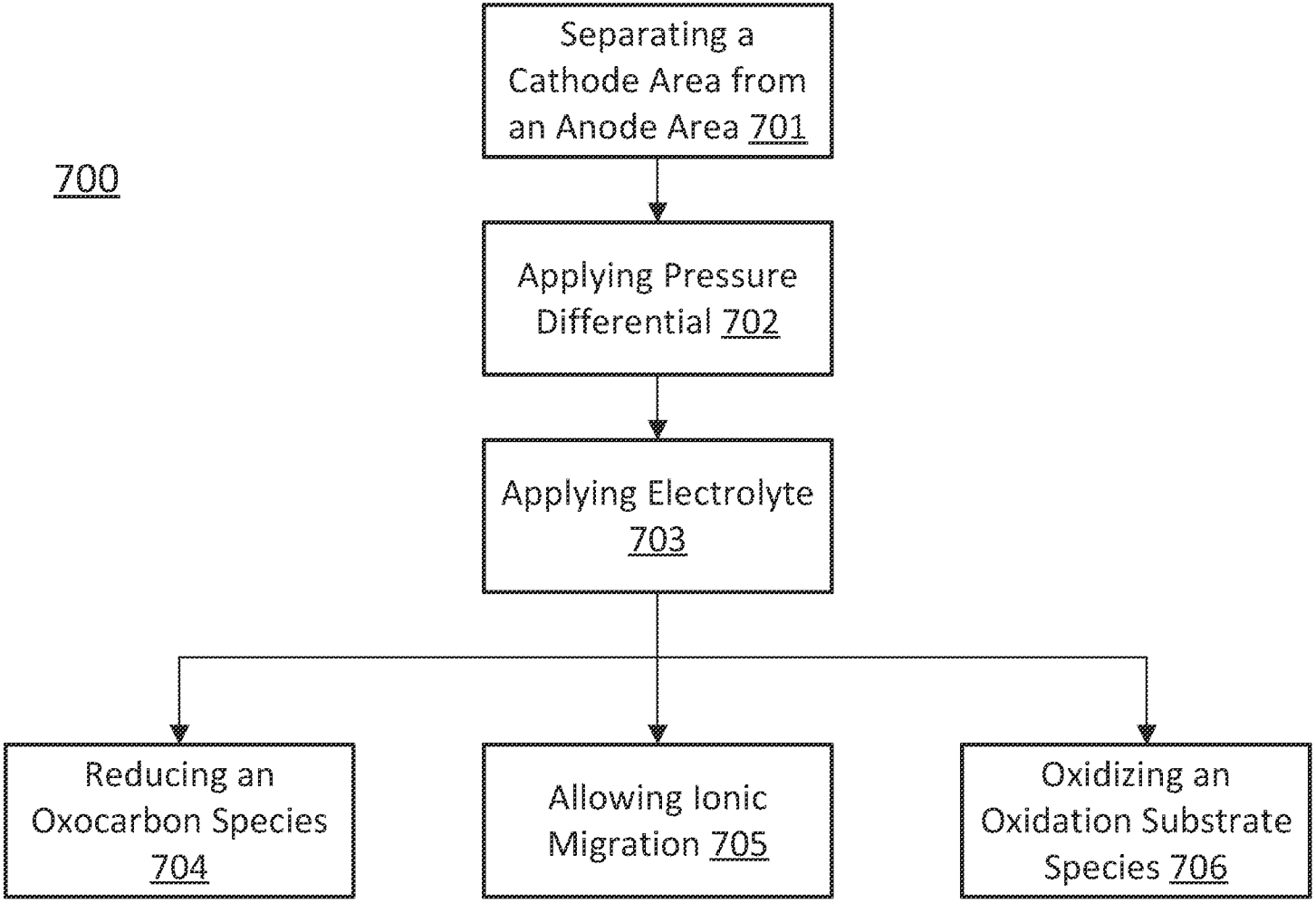
FIG. 7 includes a flow chart for a set of methods for operating an electrolysis reactor in accordance with specific embodiments of the inventions disclosed herein.

FIG. 7 illustrates a flow chart 700 for a set of methods for operating an oxocarbon electrolysis reactor comprising several steps. The process includes steps that are conducted prior to operation of the reactor and a set of steps that are conducted simultaneously during operation of the device. Flow chart 700 includes a step 701 of separating a cathode area from an anode area using a separator. The step can be conducted using the separators disclosed herein (e.g., electroneutral separators and porous separators).

Flow chart 700 also includes an optional step 702 of applying a pressure difference across the oxocarbon electrolysis reactor from the anode area to the cathode area of the reactor. The step can be conducted such that a conductive electrolyte is kept from leaking through the separator. The pressure differential can be controlled to control an amount of electrolyte that is allowed to move through the separator.

Flow chart 700 continues with an optional step 703 of applying a conductive electrolyte to the electroneutral separator. If the separator is a porous electroneutral separator, the step can include the electrolyte moving into the pores of the separator. If the separator is a porous electroneutral separator with a porous network, the step can include the conductive electrolyte extending through the electroneutral separator via the porous network. If both optional step 702 and optional step 703 are conducted and the separator is a porous separator, optional step 702 can include the conductive electrolyte being pressed away from the anode area by the pressure difference.

Flow chart 700 continues with an operational phase of the reactor in which the three illustrated steps occur at the same time. The steps include a step 704 of reducing an oxocarbon species in a cathode area, a step 706 of oxidizing an oxidation substrate in an anode area, and a step 705 of allowing ionic migration between the anode area and cathode area across the electroneutral separator. The steps are conducted simultaneously because it is the ionic migration across the separator that allows the reduction and oxidation reactions to occur in the reactor.

While the specification has been described in detail with respect to specific embodiments of the invention, it will be appreciated that those skilled in the art, upon attaining an understanding of the foregoing, may readily conceive of alterations to, variations of, and equivalents to these embodiments. The disclosure of volumes of chemicals in this disclosure is not meant to refer to a physically isolated volume as it is possible for a volume of dihydrogen to exist with a volume of carbon dioxide in a single physical volume in the form of a volume of syngas. Although examples in the disclosure were generally applied to industrial chemical processes, the same approaches are applicable to chemical processing of any scale and scope. Furthermore, while the examples in this disclosure were generally applied to the delivery of carbon monoxide to an electrolyzer, approaches disclosed herein are more broadly applicable to the delivery of any member of the oxocarbon family to an electrolyzer for the purposes of generating useful chemicals therefrom. These and other modifications and variations to the present invention may be practiced by those skilled in the art, without departing from the scope of the present invention, which is more particularly set forth in the appended claims.

What is claimed is:

1. An oxocarbon electrolysis reactor comprising:

an aqueous anode area with an aqueous oxidation substrate and an electrolyte;

a gaseous cathode area with an oxocarbon species as a gaseous reduction substrate; and an electroneutral separator saturated with the electrolyte formed of one or more polymers selected from a group consisting of: polytetrafluoroethylene, polyethylene, polypropylene, polystyrenes, polysiloxanes, polyether sulfone, and polyacrylonitrile, and separating the anode area and the cathode area while allowing ionic migration between the anode area and cathode area, and wherein the gaseous reduction substrate is diffused across a cathodic catalyst and the separator is pressed against the cathodic catalyst;

wherein: (i) the electroneutral separator is a polymer having a coating; (ii) the coating increases a hydrophilicity of the electroneutral separator; (iii) the coating is one of an amine and an alcohol; (iv) the electroneutral separator is less than 250 microns thick where thickness is measured from the anode area to the cathode area; and (v) the reactor comprises a pressure difference greater than 200 mbar across the oxocarbon electrolysis reactor from the cathode area to the anode area.

2. The oxocarbon electrolysis reactor of claim 1, wherein:

the electroneutral separator is ionically conductive; and the electroneutral separator is formed by electrically insulative material.

3. The oxocarbon electrolysis reactor of claim 1, wherein:

the electroneutral separator is formed by a polymer; and the electroneutral separator is electroneutral in that no charged chemicals are chemically bound into the electroneutral separator.

4. The oxocarbon electrolysis reactor of claim 1, wherein:

the electrolyte allows for diffusion of an anion produced by a reduction of the reduction substrate from the cathode area to the anode area.

5. The oxocarbon electrolysis reactor of claim 1, wherein:

the electroneutral separator is a porous electroneutral separator.

6. The oxocarbon electrolysis reactor of claim 1, further comprising:

a porous network formed by a set of pores and extending through the electroneutral separator.

7. The oxocarbon electrolysis reactor of claim 6, wherein:

the set of pores is a set of pores each having less than one millimeter in diameter.

8. The oxocarbon electrolysis reactor of claim 6, wherein the electrolyte extends through the electroneutral separator via the porous network.

9. The oxocarbon electrolysis reactor of claim 1, wherein:

the electroneutral separator is a polymer formed by chain growth polymerization of one or more monomers selected from a group consisting of: vinyls, olefins, styrenes, acrylates, methacrylates, acrylamides, methacrylamides, epoxides, lactones, lactams, siloxanes, sulfones, and carbonates.

10. The oxocarbon electrolysis reactor of claim 1, wherein:

the electroneutral separator is a polymer formed by step growth polymerization of one or more chemicals selected from a group consisting of: multifunctional alcohols, amines, thiols with one or more multifunctional carboxylic acids, acid halides, alkyl halide, esters, isocyanates, aldehydes, ketones, and anhydrides.

11. An oxocarbon electrolysis reactor comprising:

an aqueous anode area with an aqueous oxidation substrate and an electrolyte;

a gaseous cathode area with an oxocarbon species as a gaseous reduction substrate;

a porous separator saturated with the electrolyte, formed of one or more polymers selected from a group consisting of: polytetrafluoroethylene, polyethylene, polypropylene, polystyrenes, polysiloxanes, polyether sulfone, and polyacrylonitrile, and separating the anode area and the cathode area, and wherein the gaseous reduction substrate is diffused across a cathodic catalyst and the separator is pressed against the cathodic catalyst; and a porous network formed by a set of pores and extending through the porous separator;

wherein: (i) the porous separator is a polymer having a coating; (ii) the coating increases a hydrophilicity of the porous separator; (iii) the coating is one of an amine and an alcohol; (iv) the separator is electroneutral and is less than 250 microns thick where thickness is measured from the anode area to the cathode area; and (v) the reactor comprises a pressure difference greater than 200 mbar across the oxocarbon electrolysis reactor from the cathode area to the anode area.

12. The oxocarbon electrolysis reactor of claim 11, wherein:

the set of pores is a set of pores each having less than one millimeter in diameter.

13. The oxocarbon electrolysis reactor of claim 11, further comprising:

the porous separator is a polymeric electroneutral porous separator; and the polymeric electroneutral porous separator has no charged chemicals bound into the polymeric electroneutral porous separator.

14. The oxocarbon electrolysis reactor of claim 11, wherein:

the electrolyte allows for diffusion of an anion produced by a reduction of the reduction substrate from the cathode area to the anode area.

15. A method of operating an oxocarbon electrolysis reactor comprising:

reducing a gaseous oxocarbon species in a gaseous cathode area;

oxidizing an aqueous oxidation substrate in an aqueous anode area including an electrolyte;

separating the cathode area from the anode area using an electroneutral separator pressed against a cathodic catalyst, wherein the gaseous reduction substrate is diffused across the cathodic catalyst, and formed of one or more polymers selected from the group consisting of: polytetrafluoroethylene, polyethylene, polypropylene, polystyrenes, polysiloxanes, polyether sulfone, and polyacrylonitrile;

allowing ionic migration between the anode area and cathode area across the electroneutral separator; and saturating the electroneutral separator with the electrolyte;

wherein: (i) the electroneutral separator is a polymer having a coating; (ii) the coating increases a hydrophilicity of the electroneutral separator; (iii) the coating is one of an amine and an alcohol; (iv) the electroneutral separator is less than 250 microns thick where thickness is measured from the anode area to the cathode area;

and (v) the reactor comprises a pressure difference greater than 200 mbar across the oxocarbon electrolysis reactor from the cathode area to the anode area.

16. The method of operating an oxocarbon electrolysis reactor of claim 15, wherein:

the electroneutral separator is a porous electroneutral separator having a porous network; and whereby the electrolyte extends through the electroneutral separator via the porous network.

* * * * *